US011271325B2

(12) United States Patent
Koretzky et al.

(10) Patent No.: US 11,271,325 B2
(45) Date of Patent: Mar. 8, 2022

(54) ANTENNA HAVING DAMAGE AND FAULT TOLERABILITY

(71) Applicant: Northrop Grumman Systems Corporation, Falls Church, VA (US)

(72) Inventors: Edward V. Koretzky, Rancho Palos Verdes, CA (US); Michael Herndon, Lakewood, CA (US); Jackson Ng, Hermosa Beach, CA (US)

(73) Assignee: NORTHROP GRUMMAN SYSTEMS CORPORATION, Falls Church, VA (US)

( * ) Notice: Subject to any disclaimer, the term of this patent is extended or adjusted under 35 U.S.C. 154(b) by 107 days.

(21) Appl. No.: 16/774,907

(22) Filed: Jan. 28, 2020

(65) Prior Publication Data

US 2021/0234283 A1 Jul. 29, 2021

(51) Int. Cl.

| | |
|---|---|
| ***H01Q 21/00*** | (2006.01) |
| ***H01Q 21/06*** | (2006.01) |
| ***H01Q 5/25*** | (2015.01) |
| ***H01Q 11/10*** | (2006.01) |

(52) U.S. Cl.

CPC ..... *H01Q 21/062* (2013.01); *H01Q 5/25* (2015.01); *H01Q 11/10* (2013.01); *H01Q 21/0006* (2013.01)

(58) Field of Classification Search

CPC ..... H01Q 21/062; H01Q 5/25; H01Q 9/16; H01Q 9/285; H01Q 11/10; H01Q 21/0006

See application file for complete search history.

(56) References Cited

U.S. PATENT DOCUMENTS

| | | | | |
|---|---|---|---|---|
| 7,365,699 | B2 * | 4/2008 | Grebel | H01Q 1/24 343/792.5 |
| 7,545,338 | B2 * | 6/2009 | McLean | H01Q 11/10 343/792.5 |
| 8,144,070 | B2 * | 3/2012 | Wright | H01Q 1/10 343/815 |
| 2005/0259027 | A1 * | 11/2005 | Grebel | H01Q 1/24 343/793 |
| 2016/0181867 | A1 | 6/2016 | Daniel et al. | |
| 2017/0352961 | A1 * | 12/2017 | Morrison | H01Q 7/00 |

FOREIGN PATENT DOCUMENTS

EP 3 196 978 A1 7/2017

OTHER PUBLICATIONS

International Search Report in related Application Serial No. PCT/US2020/056443, dated Jan. 29, 2021, 16 pages.

* cited by examiner

*Primary Examiner* — Vibol Tan

(74) *Attorney, Agent, or Firm* — McCracken & Gillen LLC

(57) ABSTRACT

A dipole antenna comprises N dipole elements spaced along a dimension of the antenna, each dipole element including a pair of electrically conductive structures and 2N electronic networks each coupled to a corresponding electrically conductive structure of an associated dipole element to form N pairs of electronic networks wherein each electronic network includes a port. The electrically conductive structures are electrically isolated from one another.

17 Claims, 2 Drawing Sheets

ANTENNA HAVING DAMAGE AND FAULT TOLERABILITY

FIELD OF DISCLOSURE

The present subject matter relates to radio frequency (RF) antennas, and more particularly to an RF antenna that can continue to operate in a degraded state when the antenna is damaged or suffers a fault.

BACKGROUND

Antennas that are usable in the RF band are well-known and in use in many applications. For example, a log periodic dipole array (LPDA) antenna includes a plurality of dipole elements that are spaced and mounted on a center boom. Each dipole element comprises a pair of structures that are collinear and, in a particular embodiment, have a combined length that is equal to or approximately equal to a half-wavelength (i.e., $\lambda/2$) of a resonant frequency for the dipole element. In such an embodiment, the dipoles are separated and the lengths of the dipoles increase according to one or more logarithmic functions along the boom from a front to a rear section of the antenna. As is typical a feedline is coupled to the antenna and includes two conductors that interconnect opposite phase structures of adjacent dipole elements, thus resulting in two zig-zag shaped conductors that connect the dipole elements in series. Such an antenna is capable of operation over a wide frequency band, with resonant frequencies at wavelengths equal to or approximately equal to twice the lengths of the dipole elements At times, an antenna may be subjected to a high-power narrowband pulse that is within the bandwidth of the antenna. Because the active portion(s) of the antenna that initially conduct the narrowband pulse are coupled in series with the remaining dipole elements, damaging power surges can be conducted to the remaining inactive dipole elements and/or faults can disrupt current flow to other dipole elements such that communication through the antenna may be lost entirely.

SUMMARY

According to one aspect, a dipole antenna comprises N dipole elements spaced along a dimension of the antenna, each dipole element including a pair of electrically conductive structures, 2N antenna connection leads, and 2N electronic networks each coupled between a corresponding electrically conductive structure of an associated dipole element and a corresponding one of the 2N antenna connection leads to form N pairs of electronic networks wherein each electronic network includes a port. The electrically conductive structures are electrically isolated from one another.

According to another aspect, a dipole antenna comprises a plurality of log periodic dipole elements spaced along a dimension of the antenna, each dipole element including a pair of electrically conductive structures. Each of a plurality of electrical elements is coupled to an associated one of the plurality of electrically conductive structures and the electrically conductive structures of each dipole element are electrically isolated from electrically conductive structures of other dipole elements.

Other aspects and advantages will become apparent upon consideration of the following detailed description and the attached drawings wherein like numerals designate like structures throughout the specification.

DETAILED DESCRIPTION

Figure 1:
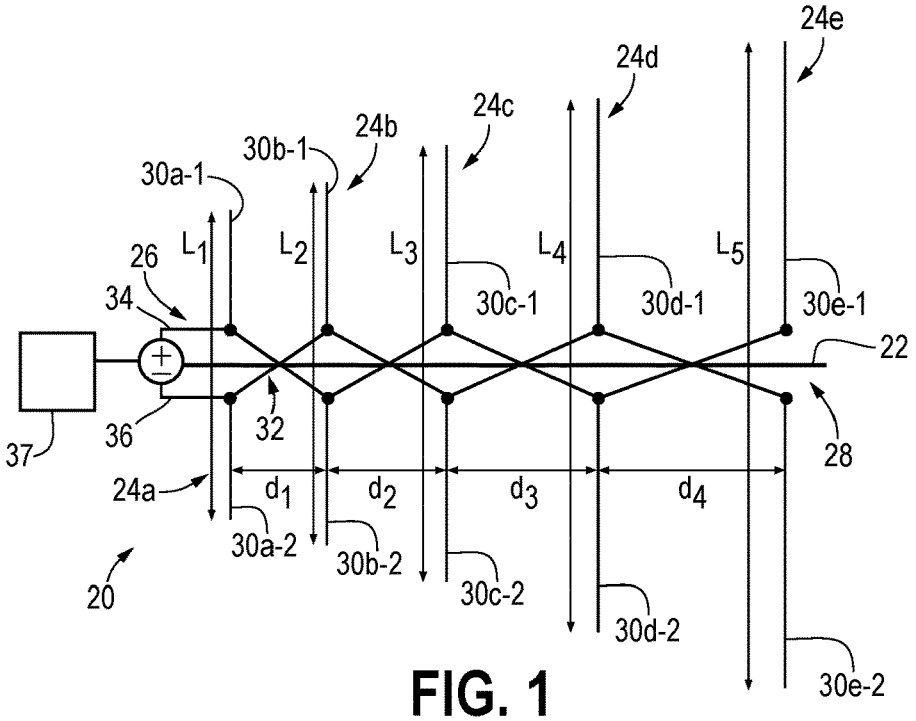
FIG. 1 PRIOR ART
FIG. 1 is a schematic diagram of a prior art LPDA antenna.

Referring to FIG. 1, a prior art LPDA antenna 20 includes a central boom 22 and a plurality of dipole elements 24*a*, 24*b*, 24*c*, . . . , 24N mounted on the boom 22 between a front end or tip 26 and a rear end 28. In the illustrated embodiment each dipole element 24, such as the element 24*a*, includes a pair of electrically conductive dipole structures 30*a*-1 and 30*a*-2 that are arranged colinearly and have a combined length equal to or slightly less than a one-half wavelength $\lambda/2$ of a resonant frequency of the antenna 20. Each of the structures 30*a*-1 and 30*a*-2, as well as corresponding dipole structures 30*b*-1 and 30*b*-2, 30*c*-1 and 30*c*-2, . . . , 30N-1 and 30N-2, may comprise a wire element, a rod, or any other electrically conductive structure. In the illustrative embodiment the dipole elements 24 are arranged parallel to one another, and are of increasing lengths and are spaced by increasing distances from another from the front end 26 to the rear end 28 according to one or more logarithmic functions, such as:

$$L_{n+1}/L_n=d_{n+1}/d_n=k;$$

where $L_n$ is a combined length of the dipole structures $\mathbf{30}_n$ of one of the dipole elements $\mathbf{24}_n$, $L_{n+1}$ is a combined length of the dipole structures $\mathbf{30}_{n+1}$ of the next longer of the dipole elements $\mathbf{24}_{n+1}$, $d_1$ is the distance between dipole elements $\mathbf{24}_n$ and $\mathbf{24}_{n+1}$, and $d_{n+1}$ is the distance between the dipole element $\mathbf{24}_{n+1}$ and a next longer dipole element $\mathbf{24}_{n+2}$, and k is a constant.

A feedline 32 extends along the boom 22. The feedline 32 is a balanced line having two conductors 34, 36 that interconnect adjacent opposite dipole structures 30. Thus, for example, the conductor 34 interconnects the structures 30*a*-1, 30*b*-2, 30*c*-1, and so on, whereas the conductor 36 interconnects the structures 30*a*-2, 30*b*-1, 30*c*-2, and so on. The dipole elements 24 may therefore be considered as being connected in series between the front end 26 and the rear end 28. An electronic network 37 is connected in series to the dipole elements 24. The electronic network 37 may comprise one or more elements of a communications system, such as a transceiver, a transmitter, or a receiver.

During use, the antenna 20 may be exposed to a high-power narrowband pulse. In such a case, the series-connection of the network 37 to the dipole elements 24 can result in damage one or more of the components of the electronic network 37 and complete inoperability of the communications system to which the antenna 20 is coupled. Such an occurrence should be avoided, if at all possible.

Figure 2:
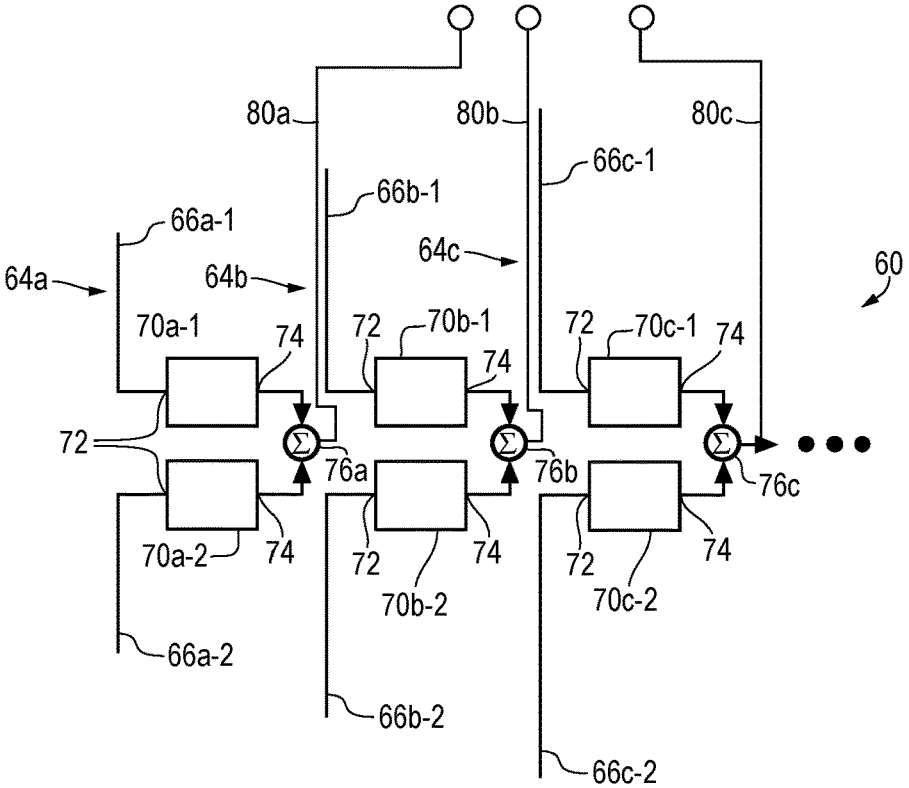
FIG. 2 is a schematic diagram of an LPDA antenna with damage and fault tolerability.

Referring next to FIG. 2, an antenna 60 of the LPDA type is illustrated, it being understood that the antenna 60 may be of an alternate type, as described in greater detail hereinafter. The antenna 60 includes a boom 59 (not shown in FIG. 2 for purposes of clarity but seen in FIG. 3) on which dipole elements 64*a*, 64*b*, 64*c*, . . . , 64N are mounted identical or similar to the dipole elements 24 described above. Thus, each dipole element 64, such as the dipole element 64*a*, includes a pair of dipole structures 66*a*-1, 66*a*-2 identical or similar to the dipole structures 30 arranged as shown in FIG. 1 according to one or more logarithmic functions, as described previously. The antenna 60 differs from the antenna 20 in that the individual dipole elements 64 are not coupled together in series. Rather, the dipole structures 66*a*-1, 66*a*-2, 66*b*-1, 66*b*-2, 66*c*-1, 66*c*-2, . . . , 66N-1, 66N-2 are electrically isolated from one another and are coupled to first ports 72 of associated electrical elements, such as electronic networks 70*a*-1, 70*a*-2, 70*b*-1, 70*b*-2, 70*c*-1, 70*c*-2, . . . , 70N-1, 70N-2, respectively. The networks 70 are arranged in pairs, such as the pair 70*a*-1 and 70*a*-2, 70*b*-1 and 70*b*-2, and so on. Second ports 74 of the networks 70 of each pair of networks are coupled together, such as by the summers 76*a*, 76*b*, 76*c*, . . . , 76N, to form N antenna connection leads 80*a*, 80*b*, 80*c*, . . . , 80N. If desired, the second ports 74 may be directly connected together (in which case the summers 76 may be omitted) or may be connected together in some other fashion and/or by other element(s) and may comprise or be connected to N antenna connection leads.

Figure 3:
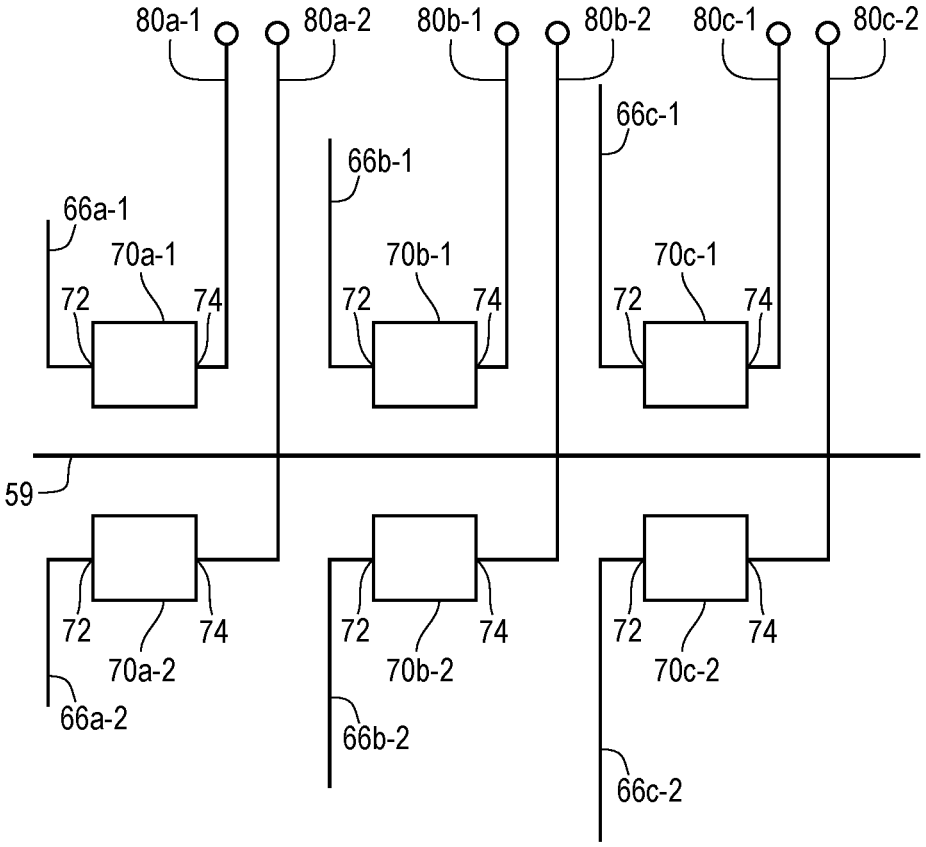
FIG. 3 is a schematic diagram of an alternative embodiment of an LPDA antenna with damage and fault tolerability.

In yet another alternative embodiment seen in FIG. 3, the ports 74 may be left separate from one another such that the ports 74 comprise or are directly connected to 2N antenna connection leads, such as leads 80*a*-1, 80*a*-2, 80*b*-1, 80*b*-2, 80*c*-1, 80*c*-2, etc., for example when the antenna is used with transmitter(s). In any event, the dipole structures 66, and thus the dipole elements 64 and networks 70 may be considered to be arranged in parallel.

In either of the embodiments of FIGS. 2 and 3, the electronic networks 70 may be identical or similar to one another or two or more of the networks 70 may be different. In any event, each network may comprise signal processing circuits and/or other communications elements to implement transceiver, transmitter, or receiver functions. Two or more of the networks 70 may be interconnected with one another or may be separate from one another. One or more of the networks 70 may be connected to processing and/or other external circuits (not shown) at the connection leads 80.

INDUSTRIAL APPLICABILITY

One consequence of the arrangement as shown in FIG. 2 is that if a narrowband pulse is applied to the antenna 60 damage can be limited to a subset of the networks 70 rather than result in complete failure of the entire communications system. Continued communications capability may be possible, albeit possibly with degraded performance, depending upon the nature of the damage. Also, repair or replacement of damaged components may be undertaken without interrupting operation of the communications system.

Another consequence of this arrangement is that because the electronics are disposed at the antenna element level, the antenna 60 can be digitized and digital data can be transmitted through the electronics while eliminating large/bulky multiplexers, beamformer networks, and wideband limiters.

Yet another consequence of the foregoing arrangement is that a fault in one of the networks 70 resulting from any occurrence will be isolated thereto, thus limiting the effects of such a fault.

The features disclosed herein are not limited to antennas of the LPDA type, but may be used with any antenna having multiple reception/transmission elements.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. It should be understood that the illustrated embodiments are exemplary only, and should not be taken as limiting the scope of the disclosure.

We claim:

1. A dipole antenna, comprising;

N dipole elements spaced along a dimension of the antenna, each dipole element including a pair of electrically conductive structures;

2N antenna connection leads; and 2N electronic networks each coupled between a corresponding electrically conductive structure of an associated dipole element and a corresponding one of the 2N antenna connection leads to form N pairs of electronic networks wherein each electronic network includes a port; and wherein the electrically conductive structures are electrically isolated from one another.

2. The dipole antenna of claim 1, wherein the dipole antenna is of the log periodic dipole array type.

3. The dipole antenna of claim 1, wherein the ports of each pair of electronic networks are coupled together by a summer.

4. The dipole antenna of claim 1, wherein each port is coupled to an antenna connection lead.

5. The dipole antenna of claim 1, wherein the ports of each pair of electronic networks are coupled together and are coupled to an antenna connection lead.

6. The dipole antenna of claim 1, wherein the ports of each pair of electronic networks are coupled together.

7. The dipole antenna of claim 1, wherein the ports of each pair of electronic networks are not coupled together.

8. The dipole antenna of claim 1, wherein the ports of each pair of electronic networks are coupled to a pair of antenna leads.

9. A dipole antenna, comprising;

a plurality of log periodic dipole elements spaced along a dimension of the antenna, each dipole element including a pair of electrically conductive structures; and a plurality of electrical elements each coupled to an associated one of the plurality of electrically conductive structures;

wherein the electrically conductive structures of each dipole element are electrically isolated from electrically conductive structures of other dipole elements.

10. The dipole antenna of claim 9, wherein each electrical element includes a port and the ports of each pair of electrical elements are coupled together by a summer.

11. The dipole antenna of claim 9, wherein each electrical element comprises an electronic network connected in pairs with associated pairs of electrically conductive structures.

12. The dipole antenna of claim 11, wherein each electronic network includes a port coupled to an antenna lead.

13. The dipole antenna of claim 12, wherein ports of each pair of electronic networks are coupled together by a summer.

14. The dipole antenna of claim 12, wherein the ports of each pair of electronic networks are coupled together and are coupled to an antenna connection lead.

15. The dipole antenna of claim 12, wherein the ports of each pair of electronic networks are coupled together.

16. The dipole antenna of claim 12, wherein the ports of each pair of electronic networks are not coupled together.

17. The dipole antenna of claim 12, wherein the ports of each pair of electronic networks are coupled to a pair of antenna leads.

* * * * *